United States Patent [19]

Patterson

[11] Patent Number: 4,930,684

[45] Date of Patent: Jun. 5, 1990

[54] CLOSURE STRIP AND METHOD FOR REMANUFACTURING A TONER CARTRIDGE AND TONER CARTRIDGE

[75] Inventor: Laurence O. Patterson, Chatsworth, Calif.

[73] Assignee: Data Products Corporation, Woodland Hills, Calif.

[21] Appl. No.: 227,300

[22] Filed: Aug. 2, 1988

[51] Int. Cl.[5] ..... B65D 88/54

[52] U.S. Cl. ..... 222/325; 222/DIG. 1; 118/653; 118/661

[58] Field of Search ..... 222/325, DIG. 1, 542; 118/653, 661; 141/18, 311 R, 364, 365, 366; 206/631, 631.1, 633, 216, 578

[56] References Cited

U.S. PATENT DOCUMENTS

| | | | |
|---|---|---|---|
| 3,999,654 | 12/1976 | Pollack | 222/DIG. 1 |
| 4,062,385 | 12/1977 | Katusha et al. | 222/DIG. 1 |
| 4,397,409 | 8/1983 | Fantuzzo et al. | 222/DIG. 1 |
| 4,478,512 | 10/1984 | Zoltner | 222/DIG. 1 |
| 4,523,615 | 6/1985 | Feenstra et al. | 141/364 X |
| 4,615,608 | 10/1986 | Mizutani | 222/DIG. 1 |

FOREIGN PATENT DOCUMENTS

| | | | |
|---|---|---|---|
| 2064482 | 6/1981 | United Kingdom | 222/325 |

*Primary Examiner*—Joseph J. Rolla
*Assistant Examiner*—David H. Bollinger
*Attorney, Agent, or Firm*—Spensley, Horn, Jubas & Lubitz

[57] ABSTRACT

A toner cartridge, the cartridge having a first and second section. A toner material is located in the first section and maintained in the first section by a gasket. The gasket comprises a flexible substrate having attached to one surface thereof, a sealing material. The gasket is inserted between the first and second sections such that the substrate is in contact with the first section and the sealing material is preferably in contact with the second section. When the gasket is removed from the toner cartridge, toner material present in the first section is allowed to pass into the second section and into operable contact with a toner carrying apparatus operably connected to the second section of the toner cartridge.

14 Claims, 2 Drawing Sheets

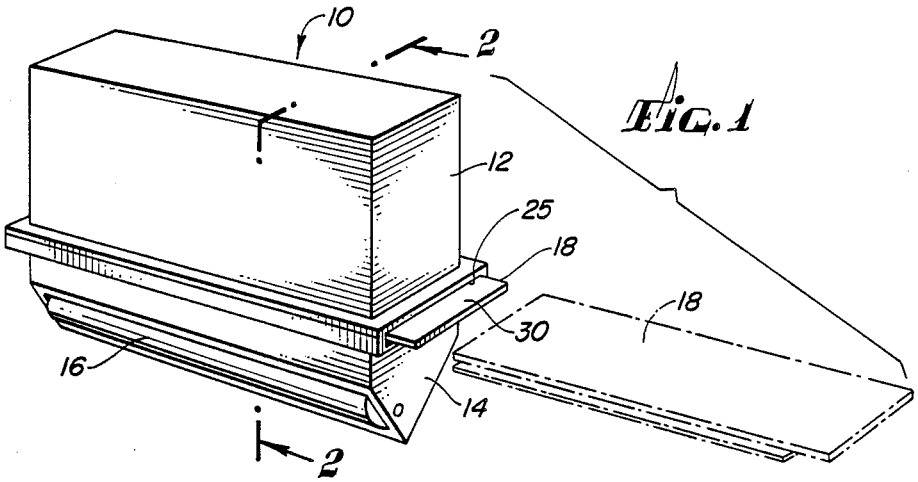
Fig. 1
Fig. 2
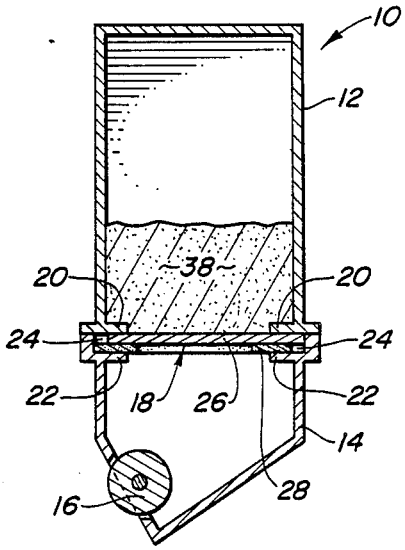
Fig. 4
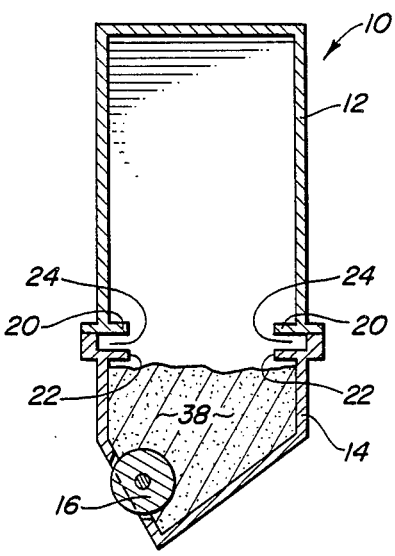
Fig. 3
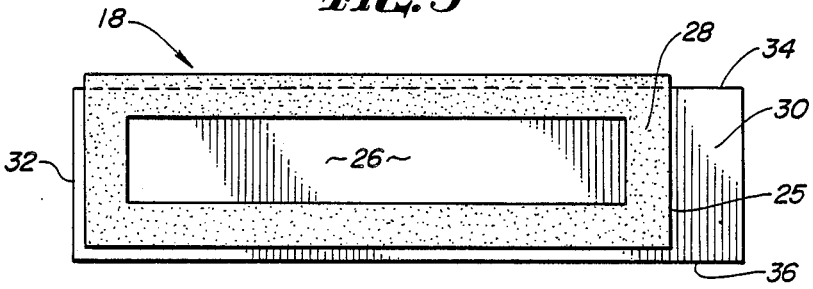

CLOSURE STRIP AND METHOD FOR REMANUFACTURING A TONER CARTRIDGE AND TONER CARTRIDGE

BACKGROUND OF THE INVENTION

The present invention relates to toner or developer cartridges suitable for use in laser printers, Xerographic printers, Xerographic copiers and the like. Specifically, the present invention relates to a toner cartridge comprising a removable gasket and a method of remanufacturing toner cartridges employing said gasket.

The use of laser printers in business and industry is rapidly expanding. Typically, such laser printers involve an electrostatic process for forming images. As part of the electrostatic process, the laser printers generally employ a toner material to form the desired images. The toner material is generally supplied in self-contained toner cartridges. The toner cartridges comprise a container for holding the toner material and a rotatable drum for carrying the toner material in a desirable manner.

As a general rule, the toner carrying apparatus of the toner cartridge has a service life considerably greater than that allowed by the amount of toner material present in the toner cartridge. Therefore, the supply of toner material present in the toner cartridge is generally exhausted long before the toner carrying apparatus is worn out. Nonetheless, due to the fact that the toner material is extremely messy and difficult to handle, it is not generally considered practical to have an end user place additional toner material in the toner cartridge. Accordingly, it is the general practice to discard the entire toner cartridge when the supply of toner material is exhausted.

In an effort to avoid the economic waste associated with disposing of the entire toner cartridge when its supply of toner material is exhausted, it is becoming increasingly common to remanufacture the toner cartridges by placing a new supply of toner material in the cartridge and reusing the cartridge including the toner carrying apparatus.

Since it is generally not practical to have the end user remanufacture the toner cartridges, the toner cartridges are generally shipped to a central remanufacturing location, remanufactured, and shipped back to the end users. Accordingly, it is necessary to remanufacture the toner cartridges such that they are capable of being transported through the mail and the like.

When the toner cartridge is initially manufactured, it is adapted to be transported through the mail and the like. It is the general practice to form the toner cartridge in two sections. The first section is intended to contain the toner material during transport of the toner cartridge. The second section contains the toner dispensing means and toner material during operation of the laser printer. Generally, due to the nature of the toner carrying apparatus, it is possible for toner material to leak from the toner cartridge in the area of the toner carrying apparatus. Therefore, it is impractical to have the toner material located in the second section during shipment of the toner cartridge. Accordingly, a removable seal is inserted between the first section and the second section such that, during shipment, the toner material is maintained in the first section. After the end user receives the toner cartridge and has or is ready to place the toner cartridge in the laser printer, the seal separating the first section and the second section is removed and the toner material located in the first section is allowed to fall into the second section into an operable location about the toner carrying apparatus.

During the initial manufacturing process, it is relatively easy to seal the first section from the second section. Generally, the first and second sections are formed separately, with a seal being placed on the first section. The first section and second section are then joined in such a manner that the seal separates the two sections, but upon removal of the seal, the sections are in communication with one another. Unfortunately, during a remanufacturing process, it is not easy to separate the first and second sections in order to again seal the first section with the toner material contained therein. Nonetheless, it is still generally desireable to seal the toner material in the first section in order that the toner cartridge may be shipped to the end user.

SUMMARY OF THE INVENTION

It is to the goal of achieving a simple, effective and economical method for sealing a toner material in a first section of a toner cartridge for shipment of the cartridge that the present invention is directed. This goal is achieved in a toner cartridge comprising a first section defining an opening, and a second section defining an opening, said second section containing a toner carrying means. The first and second sections are separated by a gasket comprising a flexible substrate, said flexible substrate having adhered to one side thereof a sealing material. The sealing material is present on the substrate generally along at least a portion of the periphery of said substrate. The gasket is removably inserted into the toner cartridge between the first and second sections such that the flexible substrate generally abuts the first section and the sealing material generally abuts the second section.

The present invention also concerns a method of remanufacturing a toner cartridge. The method involves providing a spent toner cartridge which toner cartridge has a first section and a second section. The first and second sections abut one another with a toner carrying means being operably connected to the second section. A removable gasket is provided which gasket comprises a generally flexible substrate having a sealing material present on one side of the substrate. The sealing material is present on the substrate generally along at least a portion of the periphery of the substrate and corresponds to the shape of the abutting portions of the first and second sections. The removable gasket is inserted between the first and second sections such that the flexible substrate generally abuts the first section and the sealing material generally abuts the second section. A quantity of toner material is then placed in the first section with the gasket preventing the toner material from entering the second section until such time as the gasket is removed from the toner cartridge.

BRIEF DESCRIPTION OF THE DRAWINGS

FIG. 1 illustrates a perspective view of a toner cartridge according to the present invention.

FIG. 2 illustrates a cross-section taken along line 2—2 of FIG. 1.

FIG. 3 illustrates a top plan view of one embodiment of the removable gasket of the present invention.

FIG. 4 illustrates the cross-section of FIG. 2 after removal of the gasket.

DETAILED DESCRIPTION OF THE ILLUSTRATED EMBODIMENT

Figure 2A:
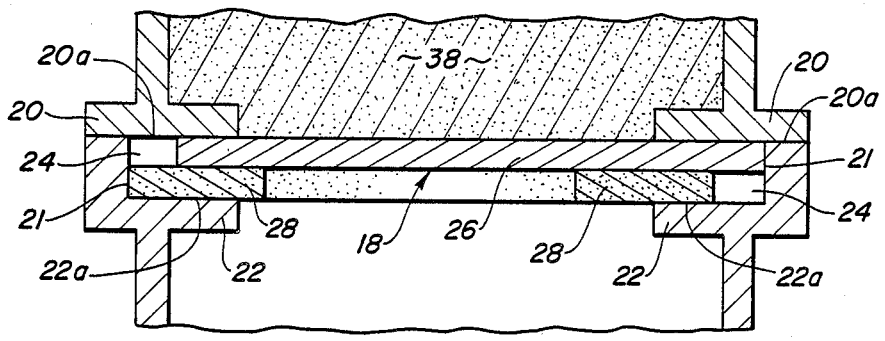
FIG. 2A illustrates an enlargement of a portion of the cross-section of FIG. 2.

The present invention concerns a toner cartridge. The toner cartridge of the present invention employs a specially designed gasket which allows the toner cartridges to be remanufactured, thus extending the life of the toner cartridge.

The invention can best be understood by reference to the attached drawings wherein FIG. 1 represents a perspective view of a toner cartridge 10 according to the present invention. Those skilled in the art will recognize that the toner cartridge may comprise a variety of different shapes depending on the laser printer, Xerographic copier or the like in which it is intended to be used. Nevertheless, the toner cartridges possess certain general characteristics hereinafter described, which are common to many toner cartridges.

The toner cartridge 10 comprises a first or toner container section 12 attached to a second or hopper section 14, which second section comprises a toner carrying means 16. Toner carrying means 16 is operably connected to the second section 14 such that a toner material contained therein can be dispensed in a desirable manner. The first section 12 and the second section 14 both define openings which abut one another, thus providing communication between the first and second sections. The first section 12 and the second section 14 are separated by a gasket or closure strip 18. The gasket 18 fits into a channel defined by the toner cartridge 10 and located at the interface area of the first section 12 and the second section 14. When the gasket 18 is in place, a toner material contained in first section 12 is maintained generally within the first section 12. When the gasket 18 is removed from the toner cartridge 10 via an access slit 25, toner material present in the first section 12 is allowed to pass into the second section 14 and into operable contact with the toner carrying means 16.

FIG. 2 illustrates a cross-section of the toner cartridge 10 illustrated in FIG. 1 taken along line 2—2 of FIG. 1. As can be seen by reference to FIG. 2, the gasket 18 is located between the first section 12 and the second section 14. The gasket 18 fits in a pair of opposed channels 24 defined by container lips 20 of the first section 12 and hopper lips 22 of the second section 14. The lips 20 and 22 form a channel 24 which has a container lip wall **20*a*, a hopper lip wall 22*a*, and a bottom wall 21. The gasket 18 fits within the channel 24 to seal the first section 12 from the second section 14. A toner material 38 is located in the first section 12**.

FIG. 3 illustrates one embodiment of the gasket 18 according to the present invention. The gasket 18 comprises a thin generally flexible strip of a substrate material 26. The substrate material is, in the illustrated embodiment, generally rectangular in shape having two relatively long edges and two relatively short edges. The substrate is shaped to snugly fit within the channel 24. Additionally, the substrate material 26 is shaped to contact substantially all of the interface surfaces between the first section 12 and the second section 14.

The substrate strip must possess sufficient firmness or rigidity to allow it to be guided into channel 24 and yet must be flexible enough to permit a degree of bending to allow for more easy insertion and better seal. Any material possessing the described characteristics is suitable for use in the present invention. Exemplary materials from which the substrate can be formed are thermoplastic or thermosetting polymeric resinous materials, paperboard, metal, and the like. Exemplary of suitable thermoplastic or thermosetting polymeric resinous materials are epoxy resins, glass reinforced epoxy resins, polyethylene, polypropylene, polycarbonates, nylons, styrene, ABS, rubber-modified styrene, and the like. The thickness of the substrate. depends on the shape of the channel 24, thickness of the sealing material (hereinafter described) and the material from which the substrate is manufactured. The substrate 26 generally has a thickness of from about 0.01 inch to about 0.15 inch. In one embodiment of the present invention, wherein the substrate is manufactured from a glass reinforced epoxy resin, the substrate has a thickness of from about 0.015 to about 0.025 inch.

The gasket 18 comprises a sealing material 28 adhered to one side of the substrate 26. The sealing material 28 serves to provide a desirable seal between the first section 12 and the second section 14. Accordingly, the sealing material is generally somewhat compressable. In the illustrated embodiment, the sealing material 28 is located generally along the periphery of the gasket 18. The sealing material 28 defines a shape on the substrate 26 corresponding to the area of interface between the first section 12 and the second section 14. As can be seen by reference to FIG. 3, the sealing material is located along three of the outer edges of the substrate 26. On the fourth edge, the sealing material is located slightly in from the periphery of the substrate 26. Thus, while the sealing material 28 generally corresponds to the shape of the interface between the first and second sections, the substrate 26 defines a tab portion 30. The tab portion 30 is designed such that when the gasket 18 is in place in the toner cartridge, tab 30 extends outside the toner cartridge to allow an end user to pull on the tab 30 and thereby remove the gasket 18 from the toner cartridge.

The sealing material 28 may comprise a variety of materials including known gasket materials. Any material capable of performing the described sealing function is suitable for use in the present invention. Exemplary of such materials are felt, leather, cork, rubber, thermoplastic as themosetting polymeric materials and the like. The sealing material 28 generally has a thickness of from about 0.01 inch to about 0.08 inch, preferably from about 0.015 inch to about 0.025 inch. The exact thickness chosen will depend on the particular sealing material, shape of channel 24, and nature of substrate 26.

In one embodiment of the present invention, it has been found desirable to vary the positioning of the sealing material 28 on the substrate 26 such that along some portions of the gasket the sealing material 28 is set back slightly from the edge of the substrate 26 and, in some locations, the sealing material 28 extends slightly beyond the edge of the substrate 26. For example, in the embodiment illustrated in FIG. 3, the sealing material 28 is set back slightly from the relatively short edge 32 and from one relatively long edge 36 of substrate 26. However, along the relatively long edge 34 of substrate 26, the sealing material 28 extends slightly beyond the edge of substrate 26. The exact location of the sealing material 28 relative to the substrate 26 can best be determined for a given toner cartridge on a case-by-case basis.

Contrary to their initial beliefs, applicants discovered that the best results are achieved when the gasket 18 is inserted into the channel 24 such that the side of the substrate 26 not having the sealing material 28 adhered thereto is in operable contact with the interface portion of the first section 12. Accordingly, the sealing material 28 is in operable contact with the interface portion of the second section 14. Applicants have discovered that if the gasket 18 is placed in the toner cartridge such that the sealing material 28 is in contact with the first section 12, toner material present in the first section 12 leaks out of the first section 12 into the second section 14 and out of the toner cartridge. By reversing the order such that the sealing material is generally not in contact with the first section, they are able to maintain the toner material in the first section during shipment.

FIG. 4 illustrates the cross-section illustrated in FIG. 2, after removal of the gasket 18. When gasket 18 is removed, the toner material 38, originally present in the first section 12, is allowed to pass into the second section 14. As such, the toner material 38 comes into operable contact with toner carrying means 16.

The toner carrying means 16 generally comprises a cylinder capable of rotating, picking up toner material from within the second section 14, and exposing said toner material on the outer surface of the cylinder. Those skilled in the art will appreciate devices capable of carrying a toner material as well as suitable toner materials. It is further understood that in some embodiments it may be desirable to employ the present invention in use with developer materials. In such instances, a developer compound is substituted for, or used in combination with, the toner material.

Discovery of the gasket and means of employing the gasket which allow for toner material present in the first section 12 to be maintained within the first section 12, has allowed the inventors to develop a method for remanufacturing toner cartridges. The steps of the method comprise providing a spent toner cartridge. By the term "spent" it is meant that the toner cartridge has exhausted its supply of toner material, but that the other parts of the toner cartridge are in general operable working condition. The spent toner cartridge generally has the configuration discussed hereinbefore, except that no gasket is present between the first and second sections. While a seal was probably originally present, this seal was removed by the end user to allow toner material originally contained in the first section 12 to pass into the second section 14.

A gasket generally as illustrated in FIG. 3 and as hereinbefore discussed is also provided. The gasket is inserted into the toner cartridge such that the substrate is in contact with the first section 12 and the sealer material is in operable contact with the second section 14. After the gasket is in place separating the first section 12 from the second section 14, an amount of toner material is inserted into the first section 12. The toner cartridge so recharged is then shipped to an end user. The end user grabs the gasket 18 by the tab portion 30, removes the gasket 18 from the toner cartridge, and inserts the toner cartridge into the laser printer, copier or the like.

Those skilled in the art will recognize that numerous modifications can be made without departing from the scope of the invention as set forth in the pending claims. Accordingly, it is to be understood that the foregoing is meant to be merely illustrative and is not intended to limit, in any manner, the scope of the invention as set forth in the claims.

What is claimed is:

1. A reusable toner-proof closure strip for sliding insertion/removal in a toner cartridge having a toner container section having a container lip, a hopper section having a hopper lip abutting the container lip to form a pair of opposed channels within the toner cartridge, each of the channels having a container lip wall, a hopper lip wall, and a bottom wall, and an access slit in the cartridge; said closure strip comprising:

a firm substrate strip of a width slightly less than the distance between the bottom walls of the opposed channels, of a thickness less than the distance between the container lip wall and the hopper lip wall of each channel, and of a length sufficient to sealingly abut the container lip during insertion in the slit while leaving a tab portion outside the slit; and resilient sealing means attached to one face of the substrate strip for making the closure strip fit snugly between the bottom walls of the channels and snugly between the container lip wall and the hopper lip wall of each channel.

2. The closure strip of claim 1, wherein the firm substrate strip is formed from a material selected from the group consisting of thermoplastic and thermosetting polymeric resinous materials.

3. The closure strip of claim 1 wherein the firm substrate strip is formed from a glass reinforced epoxy resin.

4. The closure strip of claim 1 wherein the firm substrate strip is generally rectangular in shape having two relatively long edges and two relatively short edges.

5. The closure strip of claim 4, wherein the resilient sealing means is located generally along the two relatively long edges and one of the relatively short edges of the firm substrate strip.

6. The toner cartridge of claim 5, wherein the resilient sealing means extends slightly beyond the two relatively long edges and is recessed slightly from one of the relatively short edges.

7. The closure strip of claim 1 wherein the resilient sealing means comprises a resilient strip attached to the face of the substrate strip which does not abut the container lip during insertion of the closure strip in the slit.

8. The closure strip of claim 7 wherein the resilient strip is of a width and length sufficient to abut the hopper lip during insertion of the closure strip in the slit and extends along and slightly beyond a side edge of the substrate strip.

9. A toner cartridge comprising:

a container section having a container lip;

a hopper section having a hopper lip abutting the container lip to form a pair of opposed channels within the toner cartridge;

each of the channels having a container lip wall, a hopper lip wall, and a bottom wall;

an access slit in the cartridge; and a reusable toner-proof closure strip having:

a firm substrate strip of a width slightly less than the distance between the bottom walls of the opposed channels, of a thickness less than the distance between the container lip wall and the hopper lip wall of each channel, and of a length sufficient to sealingly abut the container lip during insertion in the slit while leaving a tab portion outside the slit, and resilient sealing means attached to one face of the substrate strip for making the closure strip fit snugly between the bottom walls of the channels and snugly between the container lip wall and the hopper lip wall of each channel.

10. The toner cartridge of claim 9, wherein the hopper section includes toner carrying means comprising a rotatable cylinder.

11. A method of resealing a toner cartridge, comprising the steps of:

(i) providing a spent toner cartridge having:

a container section having a container lip, a hopper section having a hopper lip abutting the container lip to form a pair of opposed channels within the toner cartridge, each of the channels having a container lip wall, a hopper lip wall, and a bottom wall, and an access slit in the cartridge;

(ii) providing a reusable toner-proof closure strip having:

a firm substrate strip of a width slightly less than the distance between the bottom walls of the opposed channels, of a thickness less than the distance between the container lip wall and the hopper lip wall of each channel, and of a length sufficient to sealingly abut the container lip, inserted in the slit and leaving a tab portion outside the slit, and resilient sealing means attached to one face of the substrate strip for making the closure strip fit snugly between the bottom walls of the channels and snugly between the container lip wall and the hopper lip wall of each channel; and (iii) sliding the closure strip into the access slit to sealingly abut the container lip.

12. The method of claim 11, wherein the firm substrate strip is generally rectangular in shape having two relatively long edges and two relatively short edges.

13. The method of claim 12, wherein the resilient sealing means is located generally along the two relatively long edges and one of the relatively short edges of the firm substrate strip.

14. The method of claim 13, wherein the resilient sealing means extends slightly beyond the two relatively long edges and is recessed slightly from one of the relatively short edges.

* * * * *